United States Patent [19]

Weil

[11] Patent Number: 5,011,542

[45] Date of Patent: Apr. 30, 1991

[54] METHOD AND APPARATUS FOR TREATING OBJECTS IN A CLOSED VESSEL WITH A SOLVENT

[76] Inventor: Peter Weil, Helene-Mayer-Ring 10, D-8000 Munich, Fed. Rep. of Germany

[21] Appl. No.: 332,274

[22] PCT Filed: Jul. 21, 1988

[86] PCT No.: PCT/EP88/00671

§ 371 Date: Mar. 9, 1989

§ 102(e) Date: Mar. 9, 1989

[87] PCT Pub. No.: WO89/01057

PCT Pub. Date: Feb. 9, 1989

[30] Foreign Application Priority Data

Aug. 1, 1987 [DE] Fed. Rep. of Germany ..... 3725565

[51] Int. Cl.[5] ..... B08B 3/02; B08B 3/08; B08B 3/10

[52] U.S. Cl. ..... 134/38; 134/12; 134/26; 134/31; 134/36

[58] Field of Search ..... 134/12, 26, 31, 36, 134/38, 105, 109, 200; 203/14

[56] References Cited

U.S. PATENT DOCUMENTS

| | | | |
|---|---|---|---|
| 2,385,564 | 9/1945 | Booth | 134/12 |
| 3,338,756 | 8/1967 | Leon | 134/38 |
| 3,794,524 | 2/1974 | Nogueira | 134/31 |
| 4,770,197 | 9/1988 | Prisco | 134/109 |

FOREIGN PATENT DOCUMENTS

| | | | |
|---|---|---|---|
| 579891 | 7/1959 | Canada | 203/14 |
| 1001934 | 12/1976 | Canada | 134/12 |

*Primary Examiner*—Olik Chaudhuri
*Assistant Examiner*—Ourmazd S. Ojan
*Attorney, Agent, or Firm*—Toren & McGeady

[57] ABSTRACT

In a method, especially for stripping enamel and removing coatings from objects, the advantages of a solvent treatment are to be retained, without having to put up with the disadvantages of contaminating the environment. This is accomplished essentially by using in a closed treating vessel a treating mixture with at least a preponderance of a solvent with a proportion of water in excess of that required for an azeotropic mixture and carrying out the treatment while boiling the treating mixture. After the treating mixture is removed from the vessel, any solvent components still present are distilled off azeotropically from the system with water and removed before the vessel is opened.

7 Claims, 1 Drawing Sheet

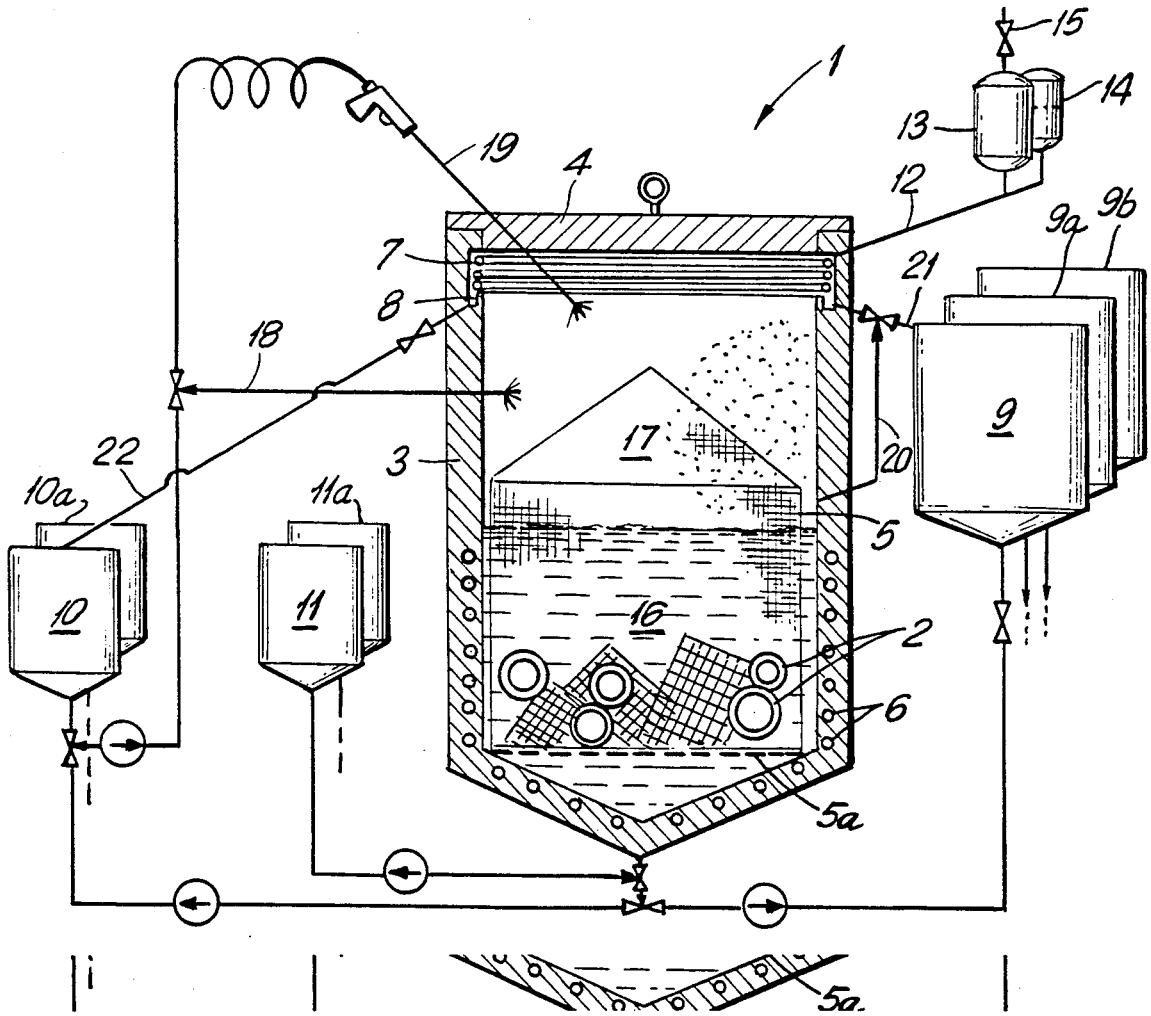
1
15
14
13
12
19
4
9a
9b
7
21
8
18
9
17
20
22
3
10a
11a
5
10
11
16
2
6
5a
5a

METHOD AND APPARATUS FOR TREATING OBJECTS IN A CLOSED VESSEL WITH A SOLVENT

OBJECT OF THE INVENTION

The invention is directed to a method and an apparatus for the treatment of objects in a closed vessel with solvents. The objects to be treated are treated at least for a time by immersion in solvents and subsequently washed by spraying in a solvent-free area of the vessel.

BACKGROUND INFORMATION AND PRIOR ART

From the German Auslegeschrift 3,300,666, a method is known for washing small objects. In this method, the small objects in treatment baskets are passed through the solvent in a closed vessal and washed by spraying above the level of the solvent. This method is used as a washing method and has some advantages. However, it is not suitable for removing coatings or stripping enamel from objects.

To remove the coating or strip the enamel from the objects to be treated, so-called cold enamel-stripping methods in large open tubs are known. These methods have the serious disadvantage that they are injurious to health due to vapors occurring above and in the surroundings of the immersion basins. Moreover, on removal of the objects from the tubs, adherent solvents may be released. The solvents, which run or drip from the parts, may reach the soil or underground water. Moreover, methylene chloride evaporates vary rapidly and thus additionally contaminates the air.

Moreover, the solvent may become entrained in the treated parts. There are chlorine-containing solvents in the paint residues, so that the disposal of the latter is expensive. Furthermore, only a limited use of additives, such as phenols, cresols, etc. is possible for health and environmental reasons. When the immersion baths contain about 50% sludge, the whole system must be destroyed or exchanged. Due to the more stringent demands with respect to environmental impact, this known technology has been replaced by other methods.

For example, it is known that pyrolysis may be carried out at higher temperatures. For such a pyrolysis, which may take place at temperatures around 400° C., there are natural limitations with regard to the material of the objects to be treated. For example, no temperature sensitive parts, such as wood, plastics, hardened metals, thin metal sheets, light metals, nonferrous heavy metals, soldered parts, magnetized metals, etc. can be treated. As for the rest, halogen compound may occur in the hot waste gases, for example, when polyvinyl chloride or chlorinated rubber are carbonized. These acidic gases can be neutralized in so-called post-scrubbers. However, highly toxic dioxins are formed during the combustion (Seveso). These dioxins may then be found in the scrubbing water or reach the environment through the smoke stack.

A different technology consists of the cryostatic stripping of enamel at very low temperatures of about D196° C. in liquid nitrogen. However, this is associated with great technical effort. The area of use is also limited, especially in the case of elastic and thin layers of enamel. Unwanted stresses may also develop, especially in the region of welded and soldered sites.

Enamel stripping by combustion is no longer possible at the present time already for environmental reasons.

Even if these reasons did not exist, such a method could be used only on a limited scale, if at all.

Aside from the treatments described above, a so-called hot enamel stripping in hot alkali liquors or acids, such as sulfuric acid, is known. This treatment is dangerous; heavy metals, complexing agents and surfactants accumulate in the baths, so that, finally, there may be contamination of the environment, especially of the sewage. The extremely aggressive, corrosive vapors also contaminate the environment and affect the personnel and must be contained by expensive means and neutralized. Moreover, spent corrosive liquids must be destroyed by cost-intensive means. The amount of waste materials is thus increased considerably and is a burden on the sewage treatment plant due to the large amounts of salt.

OBJECTS OF THE INVENTION

It is an object of the invention to provide a solution, with which the aforementioned disadvantages are avoided not only when stripping enamel, but also when removing other coatings from surfaces. More particularly, it shall also be possible to completely remove solvents in the coating materials and to hold them during the course of the treatment and to dispose of materials easily and to handle them without contaminating the environment.

SUMMARY OF THE INVENTION

Pursuant to the invention, this objective is accomplished by using the method for stripping enamel and removing coatings from objects, the method, at the same time, comprising at least the following additional steps:

a) as solvent, after closure of the treating vessels, a treating agent mixture with at least a preponderance of a solvent, such as methylene chloride, and an amount of water in excess of that required to form an azeotropic mixture, is used;

b) the treating agent mixture is heated to the boiling point of the mixture;

c) at the end of the treatment time, the settling and, if necessary, condensing solvent is removed from the treating vessel;

d) water is heated in the treating vessel and evaporated;

e) the solvent on or in the coating or enamel residues and the objects to be treated is distilled off azeotropically from the system with water and removed before the vessel is opened.

The method has very appreciable advantages over the known method. Through the use of a treating mixture of solvent and an excess of water (azeotropic methylene chloride : water=98.5 : 1.5%, here for example, 80 : 20%), the advantages of azeotropic distillation can be utilized. These advantages are of particular importance for the recovery of the solvent.

Due to the closed cycle, environment-contaminating emissions, as well as contamination of air soil and water are avoided. The thermal removal of halogenated coating materials can be dispensed with. As a result, there is no formation of dioxins, for example, during the pyrolysis of PVC. The treatment in the boiling treating agent mixture, which boils in the case of methylene chloride and water at 38.1° C., shortens the treatment times by a multiple, so that the throughput of such an installation can be increased or the size correspondingly reduced.

At the same time, the amounts of materials to be used can also be kept correspondingly small. A further advantage consists therein that the materials, which are to be removed from the surface of the objects to be treated, can be removed in comparatively large pieces, which can then be supplied, for example, to a recycling process. The loading of the treating liquids by extraneous materials, such as resins, etc., is also avoided or decreased over a longer period of time, so that regeneration phases become necessary less frequently.

In a development, the invention provides for the use of cycled water for the removal of solvent from the system and from the coating or enamel residues, at least a portion of this water having been used previously as a component of the treating agent mixture.

The water in the system can therefore be reused very frequently, which also makes for a very economic procedure.

One development of the invention consists therein that, after the complete removal of the solvent from the system by boiling it out and recondensing it, the parts in the treating vessel are washed by spraying and removed from the vessel and/or that the solvent-free residues are collected and used again.

It is advantageous, if only a portion of the treating vessel is filled with solvent and the level of the solvent is kept at a distance from cooling and condensing coils in the area of the lid of the vessel. With this, a vapor space is created, which is also suitable for treating objects, which are to be treated only by the treating agent vapors. The cooling and condensing coils in the area of the lid of the vessel can also prevent treatment vapors inadvertently leaving, when the lid of the vessel is open.

The invention also provides for the condensation of the vapor phase of the solvent in the upper region of the immersion vessel and for the use of the condensate as spraying agent. This has the advantage that the whole of the process, insofar as the solvent is concerned, can be carried out in cyclic fashion, that is, the danger of contaminating the environment is avoided.

It has proven to be particularly advantageous to include additives with the spraying agent. These additives may be very different in nature. For example, they may be corrosive agents (sic!!), chemicals for passivating in the event that the enamel was stripped with an acidic medium, such as formic acid, or they may be oily and/or aqueous, etc.

Aside from the procedure described here, the invention can also be used in the same manner, for example, to defat surfaces with other solvents or treating agent mixtures in the liquid or vapor phase. Such solvent or treating mixtures can then be driven off once again azeotropically, for example, by boiling with water. Example: trichloroethylene with water (ratio of trichloroethylene : water=93.4 : 6.6) or tetrachloroethane with water in a ratio of tetrachloroethane to water of 87.1 : 15.9, the principle of system displacement by the higher boiling material in a completely closed procedure being utilized here.

Basically, the azeotrope component, which contaminates the environment, is to be driven out in the closed system by the material, which contaminates the environment less or not at all (here essentially water).

Aside from the advantages described, the inventive procedure has additional advantages, such as the following:

Low operating costs, since only the low heating costs, for working with warm coating-removal agents and, later on, for distilling extractively, require energy. Thermal treatments demand temperatures of about 400° C., compared to 38.1° C. or 100° C.

Since the coating-removal agents are present for only a certain time in the system as an intermediate stage, as they are in most extractive processes, and are removed from the system after the coating-removal process, these agents do not give rise to additional waste-disposal problems. (Cold coating-removal agents frequently have to be disposed of because of sludging, when they contain about 50% enamel; this represents a doubling of waste with environmentally harmful additives and an additional burden on the disposal of the waste).

The residues that accrue, since they were in fact only detached physically and are chemically hardly changed, can frequently be reused in recycling processes for secondary coating processes. (Corresponding to the law concerning waste avoidance and reuse of raw materials.)

Due to the relatively low operating temperatures (a longer time at about 40° C. during the coating removal process and a short time at temperatures not exceeding 100° C. during the extractive phase (steam distillation)), hardly any changes take place in the basic material. The thermal methods, such as high-temperature pyrolysis and salt melt, require temperatures of 400° C. and higher and, moreover, treatment times of up to 15 hours and more, as in the case of the discontinuous chamber method. This leads to structural changes in the basic material, such as a softening of hardened materials such as spring steel, forged parts such as transporting or lifting chains, twisting, warping and stability loss of alloyed materials such as light metals, distortion and deformation of thin, punched out, drawn or cast parts. The method cannot be employed with organic materials. At the low temperatures encountered, for example, when immersing in liquid nitrogen at D196° C., there is embrittlement and a change in the crystalline structures of the parts to be treated. The result is crack formation, breakage of welded and soldered seams and material fatigue. An expensive mechanical aftertreatment by blasting with steel shot, etc. in the case of surface damage, becomes necessary.

The attenuated aggressiveness, due to the use of inhibitors in the acidic as well as in the alkaline region, makes it possible to keep the surface changes small in the case of many basic materials. Frequently, strongly corrosive methods are selected to remove extremely resistant layers from sensitive basic materials. (Hot concentrated sulfuric acid, hot sodium hydroxide solution, etc.). This implies not only surface changes, but also an expensive neutralization during the aftertreatment (oversalting of the effluent water).

The mechanical stress on the parts is insignificant. High-pressure methods with an 800 bar water jet permit coatings to be removed only from sturdy, uniform parts, such as gratings, etc.

The gentle coating removal also implies that the health of the personnel is not affected, since the chemicals only come into contact with the parts to be decoated in the closed installations. Upon opening, only decoated parts and water-wat residue are removed.

To accomplish the further objective formulated above, the invention also provides for an installation with an immersion vessel, which can be filled at least partly with a solvent mixture. This installation is characterized in that the immersion vessel is equipped with a heater in its lower region and with a cooling facility in the region of the lid provided at the top.

With the heater, it is possible to maintain the superazeotropic solvent/water mixture initially, during the treatment process, at the boiling point of this mixture. When the treatment process is concluded and the solvent has been pumped from the vessel, water, which either has remained behind in the vessel or is brought in separately, is heated. At first, at the appropriate temperature of the azeotrope, the solvent is driven off from the mixture and the coating materials.

The cooling facility in the region of the upper edge is able to condense the solvent vapors. The solvent can be removed from the vessel in this way. Further heating of the water by the heater then provides for the evaporation of the water. Here also, the condensing or cooling facility in the head region of the vessel can be utilized for returning the water to other parts of the installation. This means that all the vaporizable components can be removed from the vessel before the lid is opened up.

The cooling facility in the head region of the immersion vessel has the task of forming a type of vapor barrier for the open vessel. In the event that solvent residues, no matter for what reason, have remained in the opened vessel, their vapors can then be condensed without contaminating the environment.

In a refinement, the invention provides that the immersion vessel is equipped at least in its vapor space with a washing-by-spraying device for objects, which are brought there to be treated. This washing-by-spraying device can be installed immovably. It may, however, also be a manually operated spraying lance or the like. Of course, both possibilities may also be provided simultaneously. The vapor space is understood to be the space above a liquid level, as well as the total space within the vessel, when the treating agent mixture has been pumped off.

As mentioned, the invention has the particular advantage of a completely closed mode of operation. For this purpose, a refinement is provided, according to which there is assigned to the immersion vessel at least one storage tank for solvents, one storage tank for water and one storage tank for further treating agents, such as a neutralizing agent, etc. It should be mentioned that, of course, that several such tanks may be provided for the corresponding materials. At least one of the storage tanks for solvents can also be used as a storage tank for the treating agent mixture, that is, for example, for the mixture of methylene chloride with an amount of water in excess of that required to form an azeotropic mixture.

To prevent the risk of contaminating the environment with even the smallest amounts of solvent vapors, the immersion vessel in a further refinement is provided with an activated charcoal filter and/or a pressure equalizing vessel. With the vessel closed and after flooding with the treating agent mixture, these elements of the installation have the task bringing about an equalization of gas volumes when the heater commences to heat. The gas volume expanding above the treating agent mixture is discharged into the environment by way of the activated charcoal filter in the proportion, in which the volume expands relative to the vapor space volume, or it acts upon the pressure equalizing vessel. In a further, simple refinement of the invention, a condensate collection channel with drainage pipelines is assigned to the cooling device. The drainage pipelines may be feeding pipelines to the corresponding collection tanks for the treating agent mixture and/or for solvent and/or for water. The pipelines may, however, also be a by-pass pipelines, which returns the condensate directly to the treatment space.

SHORT DESCRIPTION OF THE DRAWING

Further details, characteristics and advantages of the invention arise out of the following description as well as out of the drawing. The single FIGURE of this drawing, as a diagrammatic sketch, shows the installation of the invention in a simplified representation.

DETAILED DESCRIPTION OF THE INVENTION

The installation 1 for the treatment, for example, for removing coatings or stripping enamel from objects 2, consists essentially of an immersion vessel 3, which can be closed off at the top by a removable lid 4. Through the opening, which is released by the lid 4, the immersion vessel 3 is charged with the objects 2 to be treated, which are disposed, for example, in an immersion basket 5, which is only indicated in the drawing.

The lower region of the immersion vessel 3 is provided with a heater 6 and the upper region in the vicinity of the lid 4 with cooling coils 7, which among themselves are equipped with a condensate channel 8. To accommodate the treatment fluid and/or the neutralization agents and/or the water, etc., storage tanks such as the treating agent tank 9, the condensate/water tank 10 and the neutralizing agent tank 11 are provided, which in the Figure are in each case supplemented by further tanks 9*a*, 9*b*, or 10*a* and 11*a*, to show that the type and size of the tank are unimportant.

In the top region of the immersion vessel 3, a pressure-relief pipeline 12 is provided, which leads to the activated charcoal installation 13 and to a pressure equalizing vessel 14. A gas volume, formed by thermal expansion upon heating, can ba discharged through the activated charcoal installation 13 and the valve 15 to the environment.

The Figure also shows that the immersion vessel 3 is half filled with liquid, so that this vessel is divided into a liquid region 16 and a vapor space 17. In the region of the vapor space 17, spray devices are provided, for example, an immovably installed spraying installation 18 and a manual spraying installation 19, the particular construction of which does not matter.

The mode of action of the installation is the following:

If the vessel is empty, it can be filled with the objects 2 for their treatment. For this purpose, the lid 4 is removed first, while the cooling system 7 is running. After changing the immersion vessel 5, which at one of its undersides is provided, for example, with an additional perforated plate 5*a*, this immersion vessel 5 is brought from above into the immersion vessel 3. The lid is now closed and, for example, a mixture of methylene chloride as well as alcohols and other solvents, acids or alkali, such as amines or surfactants, etc., and water in a superazeotropic ratio is brought in from from tank or tanks 9 or 9*a*, 9*b*. The tanks 9, 9*a*, 9*b* may be disposed higher in the gravitational direction than the highest level to which the vessel 3 is filled, so that additional pumps can be dispensed with for the filling process. On the other hand, a complete pumping out of the mixture can be assured for the emptying process.

After flooding, the heater is turned on and the treating agent mixture heated, a mixture of methylene chloride/water azeotrope in a ratio of 89.5 (TRANSLA- TOR'S NOTE: should this not be 98.5?) to 1.5% being brought to the boil at 38.1° C. The reaction is accelerated by the boiling or bubbling of the liquid, so that the treatment time for the parts 2 that are to be treated can be shortened by a multiple, such as a factor of 10 to 20, relative to the cold enamel stripping method. This means that the throughput of the installation can also be increased by a factor of 10 to 20.

During the heating process, the gas mixture expanding in the vapor space 17 is supplied over pipeline 12 to, for example, the activated charcoal filter installation 13 and then discharged over valve 15 to the environment. A vapor of solvent and water, which thereupon forms in the vapor space 17, is condensed at the cooling coils 7 and collected over the condensate collection channel 8 and returned, for example, over a bypass pipeline 20 directly to the immersion vessel 3. When the treatment is finished, the heater is turned off. If methylene chloride is used as solvent, it settles at the bottom after a short time, while the water, as the lighter medium, floats at the top. The methylene chloride can now be pumped back into the or one of the tanks 9 to **9*b*, a water portion being left behind in the immersion vessel 3**.

Now commences the extraction phase, that is, the heater is switched on once again. At the start, the methylene chloride mixture boils azeotropically once more at 38.1° C. This boiling point remains constant as long as there is methylene chloride in the system. The gas phase is condensed once again at the cooling coils and now supplied over pipeline 21 to the storage tank 9. When the temperature rises above 38.1° C., the operator knows that all the methylene chloride has been distilled off. Between this temperature and the boiling point of water, further azeotropes are formed with the other additives, such as alcohols, formic or acetic acid, esters, etc. These also can be distilled off correspondingly. At the boiling point of water, all the more volatile, lower boiling solvents have been distilled into the storage tank. The heater can now be switched off and the remaining water is pumped into the water storage tank, such as tank 10. If necessary, additional water and neutralizing agent can be added to the immersion vessel 3, in order to make acids, alkalis or other additives chemically harmless.

At the end of this step of the treatment, the lid can be taken off. The solvents are now removed completely from the immersion vessel 3. Only parts of enamels or paints or synthetic materials or other detached coating materials and possibly water are in the immersion vessel 3. While moving the immersion basket 5 slowly out of the immersion vessel 3, the parts can now be washed by spraying by the stationary or manually operated spraying installations 18 and 19 and, moreover, in such a manner, that the detached coatings, which generally have a large surface area, collect on the lower perforated plate **5*a***. Just as they can to the treatment fluid, so can additives such as corrosion prevention agents, etc., be added to the water that is to be treated. With that and due to the washing by spraying in the immersion vessel, an external place for the washing-by-spraying operation can additionally be omitted. The water-wet residues on the perforated plate can be dewatered in filter presses, etc. and recycled. If the method is conducted appropriately, the parts that have been washed by spraying and removed, are still comparatively warm, so that they dry very rapidly. This additionally acts to reduce corrosion.

With the inventive installation, a regeneration of the liquids or liquid mixtures used can also be attained in a simple manner. In the event of contamination of the liquids by very fine paint particles, pigments or the like, such as resins that have gone into solution, complete regeneration of the coating removal agent can be made possible. The whole of the treating liquid can be distilled over in one treatment step. In this case, even a partial pumping out of the liquids is omitted. Instead, depending on the boiling points, these liquids are supplied are supplied over pipeline 21 to tank 9 as solvent or over pipeline 22 to the water tank 10.

Depending on the size of the vessel or reactor 3 or on the level, to which it is filled, it is also possible, aside from the immersion treatment in the region 16, to carry out a solvent vapor treatment in the vapor space 17, if necessary simultaneously, for example of objects, which are not suitable for an immersion treatment, such as light metals or their alloys, nonferrous heavy metals, wood, plastics, etc. This procedure can also be used, for example, for defectively painted parts from electronics, from aircraft construction, from automobile manufacture, perhaps for light-metal, high-speed rims, etc. In principle, the installation can operate as a completely closed system. If a certain volume of gas is passed in an ascending process over the activated charcoal filter installation 13, then this constitutes the only output into the environment. However, this volume can also be captured in a pressure expansion vessel 14, in which case the installation is operated at a pressure slightly above that of the environment.

As already mentioned, defatting processes or other treatment processes can be conducted in the installation. This depends entirely on the liquid mixtures used or on its suparazeotropic compositions.

I claim:

1. In a method for the treatment of objects in a closed vessel with solvents for stripping enamel and removing coatings from the objects, in which the objects to be treated are treated for at least part of the time by immersion in solvents and subsequently washed by spraying in a solvent-free region of the vessel, the improvement which comprises that said method includes at least the following additional steps:

a) as solvents after closure of the treating vessels, a treating agent mixture with at least a preponderance of a solvent such as methylene chloride, and an amount of water in excess of that required to form an azeotropic mixture is used;

b) the treating agent mixture is heated to the boiling point of the mixture;

c) at the end of the treatment time, the settling and, if necessary, condensing solvent is removed from the treating vessel;

d) water is heated in the treating vessel and evaporated, whereby the water acts as a heat carrier;

e) the solvent on or in the coating or enamel residues and the objects to be treated is distilled off azeotropically from the system with water and removed before the vessel is opened.

2. A method as claimed in claim 1, wherein cycled water is used for the removal of the solvent from the system and from the coating or enamel residues, at least a portion of this water having been used previously as a component of the treating agent mixture.

3. A method as claimed in claims 1 or 2, wherein, after the complete removal of the solvent from the system by boiling off and recondensing, the parts in the treating vessel are washed by spraying and removed from the vessel.

4. A method as claimed in claims 1 or 2, wherein the solvent-free residues are collected and supplied especially to a recycling process.

5. A method as claimed in claims 1 or 2, wherein only a portion of the treating vessel is filled with solvent and the filling level of the solvent is kept at a distance from the cooling and condensing coils provided in the region of the lid of the vessel.

6. A method as claimed in claims 1 or 2, wherein the solvent mixture is also used as the liquid for washing the objects by spraying in the vapor space of the treating vessel.

7. A method as claimed in claims 1 or 2, wherein additives for passivating or corrosion protection are added to the solvent as treating liquid and/or the washing-by-spraying liquid.

* * * * *